US011365489B2

(12) United States Patent
Takeda et al.

(10) Patent No.: US 11,365,489 B2
(45) Date of Patent: Jun. 21, 2022

(54) METHOD AND APPARATUS FOR MANUFACTURING ELECTROPLATED STEEL SHEET

(71) Applicant: JFE Steel Corporation, Tokyo (JP)

(72) Inventors: Gentaro Takeda, Tokyo (JP); Yoshimichi Hino, Tokyo (JP); Soshi Yoshimoto, Tokyo (JP); Hideyuki Takahashi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 170 days.

(21) Appl. No.: 16/305,957

(22) PCT Filed: Jun. 1, 2017

(86) PCT No.: PCT/JP2017/020477
§ 371 (c)(1),
(2) Date: Nov. 30, 2018

(87) PCT Pub. No.: WO2017/213021
PCT Pub. Date: Dec. 14, 2017

(65) Prior Publication Data

US 2019/0161880 A1 May 30, 2019

(30) Foreign Application Priority Data

Jun. 9, 2016 (JP) ..... JP2016-114917

(51) Int. Cl.
*C25D 7/06* (2006.01)
*C25D 5/48* (2006.01)
*C25D 5/00* (2006.01)

(52) U.S. Cl.
CPC ..... *C25D 7/0621* (2013.01); *C25D 5/003* (2013.01); *C25D 7/0628* (2013.01);
(Continued)

(58) Field of Classification Search
CPC ..... C25D 7/0614; C25D 7/0621; C25D 5/48; C25D 7/06
(Continued)

(56) References Cited

U.S. PATENT DOCUMENTS 3,081,239 A * 3/1963 Clauss ..... C25D 21/10 366/107
3,607,366 A * 9/1971 Kurokawa ..... C23C 2/20 427/349
(Continued)

FOREIGN PATENT DOCUMENTS

EP 0181430 A1 5/1986
GB 816814 A 7/1959
(Continued)

OTHER PUBLICATIONS

Kametani et al., "A Mathematical Model for Gas-Wiping Phenomena in Hot-Dip Galvanizing Process," IFAC Automation in the Steel Industry (© 1997), pp. 59-62. (Year: 1997).*
(Continued)

*Primary Examiner* — Edna Wong
(74) *Attorney, Agent, or Firm* — RatnerPrestia

(57) ABSTRACT

A method for manufacturing an electroplated steel sheet by continuously performing electroplating on a steel sheet, the method including disposing a slit gas nozzle having an ejection port having a width wider than a width of the steel sheet in a width direction of the steel sheet on a side of an exit of an electroplating cell for the steel sheet to pass through, and ejecting a gas through the slit gas nozzle toward the steel sheet.

14 Claims, 3 Drawing Sheets

(52) U.S. Cl.
CPC ..... *C25D 7/0635* (2013.01); *C25D 7/0685* (2013.01); *C25D 7/0692* (2013.01); *C25D 7/0657* (2013.01)

(58) Field of Classification Search
USPC ..... 205/138, 152, 220
See application file for complete search history.

(56) References Cited

U.S. PATENT DOCUMENTS

| | | | | | |
|---|---|---|---|---|---|
| 4,443,304 | A * | 4/1984 | Eidschun | C25D 5/04 | 204/222 |
| 4,549,950 | A | 10/1985 | Polan et al. | | |
| 5,660,707 | A * | 8/1997 | Shastry | C23C 2/26 | 205/141 |
| 6,365,031 | B1 * | 4/2002 | Martyak | C25D 3/22 | 205/313 |
| 2004/0166360 | A1 * | 8/2004 | Imai | C23C 28/325 | 428/658 |
| 2010/0176004 | A1 * | 7/2010 | Schneider | C25D 17/001 | 205/133 |
| 2012/0175248 | A1 | 7/2012 | Vasquez et al. | | |
| 2018/0327914 | A1 * | 11/2018 | Taya | C23G 3/029 | |

FOREIGN PATENT DOCUMENTS

| | | | | | |
|---|---|---|---|---|---|
| GB | 1436744 | A | | 5/1976 | |
| GB | 1448340 | A | | 9/1976 | |
| JP | S57104684 | A | | 6/1982 | |
| JP | 57210984 | A | * | 12/1982 | C25D 5/00 |
| JP | 5985891 | A | | 5/1984 | |
| JP | 5996293 | A | | 6/1984 | |
| JP | S5991368 | U | | 6/1984 | |
| JP | 6199695 | A | | 5/1986 | |
| JP | 01111896 | A | * | 4/1989 | C25D 5/36 |
| JP | H01152296 | A | | 6/1989 | |
| JP | 03207893 | A | * | 9/1991 | C25D 7/06 |
| JP | 03207893 | A | | 9/1991 | |
| JP | 05009704 | A | * | 1/1993 | C23C 10/08 |
| JP | 06136594 | A | | 5/1994 | |
| JP | 06346211 | A | * | 12/1994 | C23C 2/20 |
| JP | 06346279 | A | | 12/1994 | |
| JP | 07207492 | A | * | 8/1995 | C23C 2/20 |
| JP | 07207492 | A | | 8/1995 | |
| JP | H08170185 | A | | 7/1996 | |
| JP | 08333698 | A | | 12/1996 | |
| JP | 09279373 | A | | 10/1997 | |
| JP | H1190522 | A | | 4/1999 | |
| JP | 2012219309 | A | | 11/2012 | |
| WO | 2013057772 | A1 | | 4/2013 | |

OTHER PUBLICATIONS

Sonin, "Jet Impingement Systems for Electroplating Applications: Mass Transfer Correlations," Journal of The Electrochemical Society (Jul. 1, 1983), vol. 130, No. 7, pp. 1501-1505. (Year: 1983).*

Korean Office Action for Korean Application No. 10-2018-7033908, dated Mar. 10, 2020 with Concise Statement of Reference of Office Action, 7 pages.

Extended European Search Report for European Application No. 17 810 199.4, dated Jul. 22, 2019, 9 pages.

International Search Report and Written Opinion for International Application No. PCT/JP2017/020477, dated Jun. 27, 2017—6 pages.

Chinese Office Action for Chinese Application No. 201780034874.0, dated Apr. 23, 2020 with Concise Statement of Relevance of Office Action, 9 pages.

Japanese Office Action for Japanese Application No. 2016-114916, dated Jan. 9, 2019, with Concise Statement of Relevance of Office Action, 4 pages.

Japanese Office Action for Japanese Application No. 2016-114917, dated Jan. 9, 2019, with Concise Statement of Relevance of Office Action, 3 pages.

Korean Office Action for Korean Application No. 10-2018-7033908, dated Oct. 21, 2020 with Concise Statement of Relevance of Office Action, 5 pages.

* cited by examiner

METHOD AND APPARATUS FOR MANUFACTURING ELECTROPLATED STEEL SHEET

CROSS REFERENCE TO RELATED APPLICATIONS

This is the U.S. National Phase application of PCT/JP2017/020477, filed Jun. 1, 2017, which claims priority to Japanese Patent Application No. 2016-114916, filed Jun. 9, 2016 and Japanese Patent Application No. 2016-114917, filed Jun. 9, 2016, the disclosures of each of these applications being incorporated herein by reference in their entireties for all purposes.

FIELD OF THE INVENTION

The present invention relates to a method for manufacturing an electroplated steel sheet, that is, a method and an apparatus for manufacturing an electroplated steel sheet having a homogeneous coating thickness and good esthetic surface appearance.

BACKGROUND OF THE INVENTION

In the manufacture of an electroplated steel sheet, known examples of a commonly usable method for electroplating a steel sheet include a horizontal flow cell method, a vertical flow cell method, and a radial cell method.

A cell structure used in a horizontal flow cell method has, as illustrated in FIG. 7, conductor rolls 2 disposed on the sides of an entrance and an exit for a strip (steel sheet) 1 to pass through and anode electrodes 3 disposed on the sides of the front and back surfaces of the strip 1. Electroplating is performed by making the strip 1 travel in a horizontal direction (in the direction of the arrows), by feeding a plating solution 4 into gaps between the strip 1 and the anode electrodes 3, and by conducting a current between the front and back surfaces of the strip 1 being a cathode, and the anode electrodes 3.

In a cell structure used in a vertical flow cell method, as illustrated in FIG. 8, a strip 1 is made to travel in a horizontal direction (in the direction of the arrows), the traveling direction is changed to a downward direction by a conductor roll 2 disposed on the side of an entrance for the strip 1 to pass through, the traveling direction of the strip 1 is then changed to an upward direction by a sink roll 6, and the traveling direction of the strip 1 is then changed to a horizontal direction by a conductor roll 2 disposed on the side of an exit for the strip 1 to pass through. Electroplating is performed by disposing anode electrodes 3 on the sides of the front and back surfaces of the strip 1 between each of the conductor rolls 2 and the sink roll 6, by feeding a plating solution 4 through flow nozzles 5 into gaps between the strip 1 and the anode electrodes 3, and by conducting a current between the front and back surfaces of the strip 1 being a cathode, and the anode electrodes 3.

In a cell structure used in a radial cell method, as illustrated in FIG. 9, a strip 1 is made to travel in a horizontal direction (in the direction of the arrows), the traveling direction is changed to a downward direction by a strip-passing roll 7 disposed on the side of an entrance for the strip 1 to pass through, the traveling direction of the strip 1 is then changed to an upward direction by a conductor roll 2, and the traveling direction of the strip 1 is then changed to a horizontal direction by a strip-passing roll 7 disposed on the side of an exit for the strip 1 to pass through. Electroplating is performed by winding the strip 1 around the conductor roll 2 so that the strip 1 is dipped in a plating solution 4, by feeding the plating solution 4 through flow nozzles 5 into gaps between the strip 1 and arched anode electrodes 3 disposed on the circumferences of circles facing the strip 1, and by conducting a current between the surface to be plated of the strip 1 being a cathode, and the anode electrodes 3.

The flow cell methods have an advantage in that it is possible to plate the front and back surfaces of a steel sheet at the same time. The radial cell method is a one-side plating method. However, in the case of the radial cell method, since a strip is made to travel while being wound around a conductor roll, it is possible to decrease the distance between the surface to be plated of the strip and anode electrodes. Therefore, there is a decrease in resistance when electroplating is performed, which results in an advantage in that it is possible to achieve a high current density with a low voltage.

In the case of electrogalvanizing, which is representative electroplating, usually, 5 to 15 cells are arrayed in series, and a plating treatment is continuously performed while a steel sheet is passed through the cells. This method has great characteristics that, since coating weight for one cell is 1 $g/m^2$ to 5 $g/m^2$, that is, small, since such coating films are placed on top of one another, and since it is possible to control a current in accordance with a line speed or a steel sheet width, it is possible to achieve a homogeneous coating weight distribution with a variation in coating weight in the width direction and the longitudinal direction being within 0.5 $g/m^2$ to 1 $g/m^2$, and also it is possible to achieve good esthetic surface appearance. On the other hand, in comparison with a galvanized steel sheet manufactured by using a continuous galvanizing method, in which annealing and zinc plating are performed in one line, the cost of an electroplated steel sheet, which is subjected to annealing and zinc plating in different lines, tends to be high.

Therefore, nowadays, various investigations are being conducted to increase a plating current density or to improve homogeneity for the purpose of improving the productivity of an electroplating line. Usually, an electroplated steel sheet is manufactured by using a plating solution having a pH of about 1.5 to 2.0 and current density of about 100 $A/dm^2$ at maximum.

Patent Literature 1 discloses a plating method in which a plating solution is ejected in a direction opposite to that in which a steel sheet travels so that the flow of the plating solution between anodes and the steel sheet is homogeneous in the width direction and the plating solution is ejected toward the surfaces of the steel sheet on the entrance side and exit side of the electrodes so that outflowing plating solution is sealed.

Patent Literature 2 discloses an electroplating method in which homogeneous plating is realized by dividing the inside of a cushion-type nozzle in the width direction so that the flow distribution of the plating solution is varied in the width direction.

Patent Literature 3 discloses a method in which the flow rate of the plating solution is controlled to be homogeneous by varying the slit aperture size of a nozzle, which feeds the plating solution, in such a manner that the slit aperture size gradually increases from the center in the width direction of a steel sheet to both edges in the width direction.

Patent Literature 4 discloses a method in which current density is increased by decreasing the pH of a plating solution and controlling the temperature and flow rate of the plating solution so that predetermined conditions are satisfied.

PATENT LITERATURE

PTL 1: Japanese Unexamined Patent Application Publication No. 59-85891

PTL 2: Japanese Unexamined Patent Application Publication No. 59-96293

PTL 3: Japanese Unexamined Patent Application Publication No. 61-099695

PTL 4: Japanese Unexamined Patent Application Publication No. 6-136594

SUMMARY OF THE INVENTION

However, in the case of the methods according to Patent Literature 1 through Patent Literature 3, even though it is possible to homogenize a coating weight in plating cells, when there is a variation in the amount of a remaining plating solution which adheres to the surface of a steel sheet in a zone between cells, in which plating is not performed, there is a variation in coating thickness due to the coating film being dissolved by the remaining plating solution, which results in a variation in coating thickness which is finally obtained. At the same time, there is a variation in crystal orientation in the coating film, which results in a variation in surface appearance (a variation in the degree of whiteness).

In addition, when the pH of a plating solution is decreased to increase current density as in the case of Patent Literature 4, there is an increase in the amount of the coating film dissolved by a remaining plating solution in a zone between cells, in which plating is not performed, which results in a more marked variation in coating thickness which is finally obtained and results in a more marked variation in surface appearance.

In view of the situation described above, an object according to aspects of the present invention is to homogenize a coating thickness which is finally obtained and to achieve good esthetic surface appearance by homogenizing the amount of a remaining plating solution which adheres to the surface of a steel sheet in a zone between electroplating cells.

The subject matter according to aspects of the present invention is as follows.

[1] A method for manufacturing an electroplated steel sheet by continuously performing electroplating on a steel sheet, the method including disposing a slit gas nozzle having an ejection port having a width wider than a width of the steel sheet in a width direction of the steel sheet on a side of an exit of an electroplating cell for the steel sheet to pass through, and ejecting a gas through the slit gas nozzle toward the steel sheet.

[2] The method for manufacturing an electroplated steel sheet according to item [1], in which the electroplating cell is a horizontal flow cell, and in which the slit gas nozzle is disposed on each side of front and back surfaces of the steel sheet downstream of conductor rolls disposed on the side of the exit for the steel sheet to pass through.

[3] The method for manufacturing an electroplated steel sheet according to item [1], in which the electroplating cell is a vertical flow cell, and in which the slit gas nozzle is disposed on each side of front and back surfaces of the steel sheet upstream of conductor rolls disposed on the side of the exit for the steel sheet to pass through.

[4] The method for manufacturing an electroplated steel sheet according to item [1], in which the electroplating cell is a radial cell, and in which the slit gas nozzle is disposed on each side of front and back surfaces of the steel sheet downstream of a conductor roll.

[5] A method for manufacturing an electroplated steel sheet by continuously performing electroplating on a steel sheet, the method including disposing a spray nozzle in a width direction of the steel sheet on a side of an exit of an electroplating cell for the steel sheet to pass through, ejecting a solution having a pH of 4 to 7 through the spray nozzle toward the steel sheet, further disposing a slit gas nozzle having an ejection port having a width wider than a width of the steel sheet in the width direction of the steel sheet downstream of the spray nozzle, and ejecting a gas through the slit gas nozzle toward the steel sheet.

[6] The method for manufacturing an electroplated steel sheet according to item [5], in which the electroplating cell is a horizontal flow cell or a vertical flow cell, and in which the spray nozzle and the slit gas nozzle are disposed on each side of front and back surfaces of the steel sheet downstream of conductor rolls disposed on the side of the exit for the steel sheet to pass through.

[7] The method for manufacturing an electroplated steel sheet according to item [5], in which the electroplating cell is a radial cell, and in which the spray nozzle and the slit gas nozzle are disposed on each side of front and back surfaces of the steel sheet downstream of a conductor roll.

[8] The method for manufacturing an electroplated steel sheet according to any one of items [1] to [7], in which the slit gas nozzle has a nozzle slit gap of 0.3 mm to 2.0 mm, in which the slit gas nozzle is disposed so that a distance between a nozzle tip and the steel sheet is 5 mm to 100 mm, and in which an ejection pressure of the slit gas nozzle is 1 kPa to 10 kPa.

[9] The method for manufacturing an electroplated steel sheet according to any one of items [1] to [8], in which a plating solution has a pH of −0.5 to 1.0.

[10] The method for manufacturing an electroplated steel sheet according to any one of items [1] to [9], in which current density is 150 $A/dm^2$ to 1200 $A/dm^2$.

[11] An apparatus for manufacturing an electroplated steel sheet in which electroplating is performed on a steel sheet which continuously travels in an electroplating cell, the apparatus including a slit gas nozzle which has an ejection port having a width wider than a width of the steel sheet and which is disposed in a width direction of the steel sheet on a side of an exit of the electroplating cell for the steel sheet to pass through.

[12] An apparatus for manufacturing an electroplated steel sheet in which electroplating is performed on a steel sheet which continuously travels in an electroplating cell, the apparatus including a spray nozzle which is disposed in a width direction of the steel sheet on a side of an exit of the electroplating cell for the steel sheet to pass through so as to eject a solution having a pH of 4 to 7 toward the steel sheet, and a slit gas nozzle which has an ejection port having a width wider than a width of the steel sheet and which is disposed in the width direction of the steel sheet downstream of the spray nozzle.

According to aspects of the present invention, since it is possible to control the amount of a remaining plating solution which adheres to the surface of a steel sheet between electroplating cells to be homogeneous, it is possible to homogenize a coating thickness which is finally obtained and to achieve good esthetic surface appearance. In addition, according to aspects of the present invention, even in the case where plating is performed by using a plating solution having a low pH and a high current density, it is possible to homogenize a coating thickness which is finally obtained and to achieve good esthetic surface appearance.

DETAILED DESCRIPTION OF EMBODIMENTS OF THE INVENTION

Hereafter, the electroplating method according to aspects of the present invention will be described with reference to FIGS. 1 through 3. Here, in the present embodiments, one of the surfaces of a strip (steel sheet) 1 is referred to as a "front surface" for the purpose of description while another surface is referred to as a "back surface". In addition, in the embodiments, the term "upstream" (or "downstream") refers to an upstream direction (or a downstream direction) with respect to the traveling direction of a steel sheet.

Figure 1:
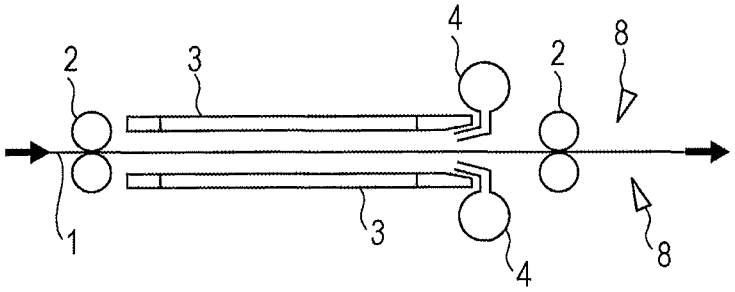
FIG. 1 is a diagram illustrating the structure of an electroplating cell used in a horizontal flow cell method according to an embodiment of the present invention.

FIG. 1 is a diagram illustrating the structure of an electroplating cell used in a horizontal flow cell method according to the embodiment of the present invention. Electroplating is performed by making a strip 1 travel in a horizontal direction, by feeding a plating solution 4 into gaps between the strip 1 and anode electrodes 3, and by conducting a current between the surfaces to be plated of the strip 1 being a cathode, and anode electrodes 3.

Slit gas nozzles 8 having ejection ports having a width wider than the width of the strip 1 are disposed in the width direction of the steel sheet so as to face the strip 1 on the side of the exit for the strip 1 to pass through, and a gas is ejected toward the strip 1.

Most of the plating solution 4 is held back by conductor rolls 2 disposed on the side of the exit for the strip 1 to pass through. However, in the case where the steel sheet has poor shape (such as an edge wave) or in the case where the conductor rolls 2 are worn, the plating solution 4 may pass through the conductor rolls 2 disposed on the side of the exit for the strip 1 to pass through. From the results of the investigations diligently conducted by the present inventors, it was clarified that, in, the case where there is a variation in the amount of a remaining acidic plating solution which adheres to the surface of a steel sheet in a zone between the electroplating cells, in which plating is not performed, there is a variation in coating thickness due to the coating film being dissolved by the remaining plating solution, which results in a variation in coating thickness which is finally obtained, and that, at the same time, there is a variation in crystal orientation in the coating film, which results in a variation in surface appearance (a variation in the degree of whiteness).

In response to such a problem, in accordance with aspects of the present invention, by disposing the slit gas nozzles 8 on the side of the exit for the strip 1 to pass through, it is possible to decrease and homogenize the amount of the remaining plating solution which adheres to the surface of the steel sheet on the downstream side of the conductor rolls 2. As a result, it is possible to homogenize the liquid film formed of the remaining plating solution which adheres to the surface of the steel sheet in a zone between the electroplating cells, in which plating is not performed. Therefore, it is possible to homogenize the coating thickness which is finally obtained and to achieve good esthetic surface appearance.

The slit gas nozzles 8 have ejection ports having a width wider than the width of the strip 1, because this is necessary to homogenize the liquid film formed of the plating solution across the whole width of the strip.

Since the zone between the conductor rolls disposed on the sides upstream and downstream of the anode electrodes is filled with the plating solution, it is preferable that the slit gas nozzles 8 be disposed downstream of the conductor rolls 2 disposed on the side of the exit for the strip 1 to pass through. In addition, it is preferable that the slit gas nozzles 8 be disposed on the sides of the front and back surfaces of the strip 1. In the case where the slit gas nozzle 8 disposed on the side of the front surface of the strip 1 and the slit gas nozzle 8 disposed on the side of the back surface of the strip 1 are disposed so as to face each other, a gas collision occurs outside of the strip 1 in the width direction due to the flows of the gas ejected through the slit gas nozzles 8 disposed on both sides, which results in a tendency for the plating solution 4 to be widely scattered. Therefore, in the case where the slit gas nozzles 8 are disposed on the sides of the front and back surfaces of the strip 1, it is preferable that a distance of 100 mm or more in the longitudinal direction of the strip 1 be created between the slit gas nozzle 8 disposed on the side of the front surface of the strip 1 and the slit gas nozzle 8 disposed on the side of the back surface of the strip 1.

Figure 2:
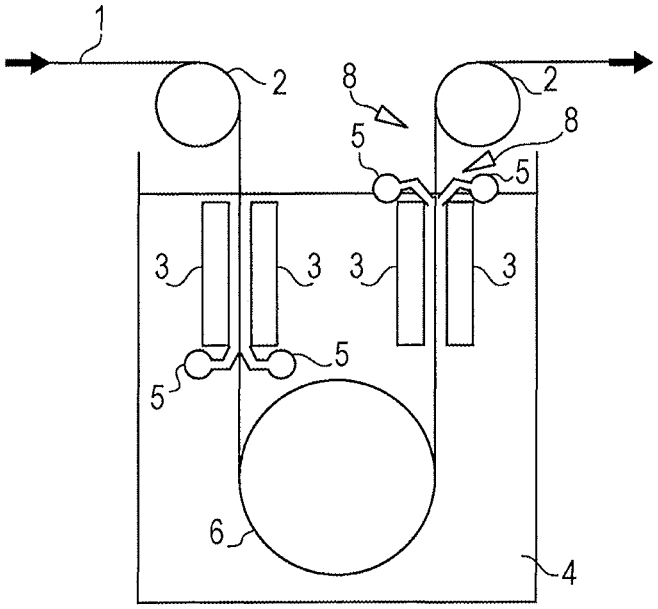
FIG. 2 is a diagram illustrating the structure of an electroplating cell used in a vertical flow cell method according to the embodiment of the present invention.

FIG. 2 is a diagram illustrating the structure of an electroplating cell used in a vertical flow cell method according to the embodiment of the present invention. Electroplating is performed by changing the traveling direction of a strip 1 to a downward direction by a conductor roll 2, by feeding a plating solution 4 through flow nozzles 5 into gaps between the strip 1 and anode electrodes 3, and by conducting a current between the surfaces to be plated of the strip 1 being a cathode, and the anode electrodes 3.

Slit gas nozzles 8 having ejection ports having a width wider than the width of the strip 1 are disposed in the width direction of the steel sheet so as to face the strip 1 at a position higher than the surface of the plating solution on the side of the exit for the strip 1 to pass through, and a gas is ejected toward the strip 1.

It is preferable that the slit gas nozzles 8 be disposed upstream of the conductor rolls 2 disposed on the side of the exit for the strip 1 to pass through so as to decrease the amount of the plating solution 4 which adheres to the conductor rolls 2. However, in the case where it is not possible to find a space in which the slit gas nozzles 8 are disposed, the slit gas nozzles may be disposed downstream of the conductor rolls 2. In addition, it is preferable that the slit gas nozzles 8 be disposed on the sides of the front and back surfaces of the strip 1. In this case, it is preferable that a distance of 100 mm or more in the longitudinal direction of the strip 1 be created between the slit gas nozzles 8 disposed on the sides of the front and back surfaces of the steel sheet to prevent the plating solution from being scattered due to the collision of the gas ejected through the slit gas nozzles 8.

Figure 3:
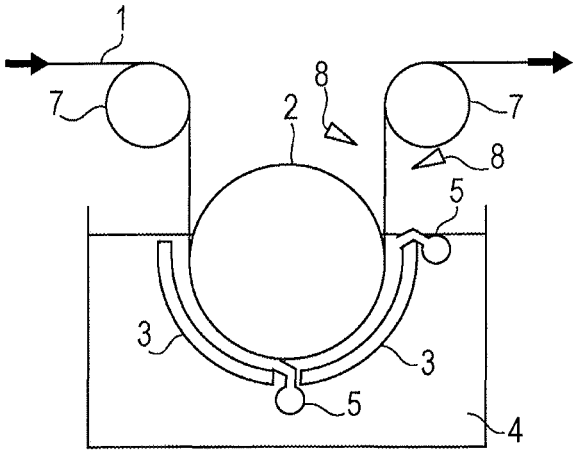
FIG. 3 is a diagram illustrating the structure of an electroplating cell used in a radial cell method according to the embodiment of the present invention.

FIG. 3 is a diagram illustrating the structure of an electroplating cell used in a radial cell method according to the embodiment of the present invention. Electroplating is performed by making a strip 1 travel with the strip being wound around a conductor roll 2, by feeding a plating solution 4 through flow nozzles 5 into gaps between the strip 1 and anode electrodes 3, and by conducting a current between the surface to be plated of the strip 1 being a cathode, and the anode electrodes 3.

Slit gas nozzles 8 having ejection ports having a width wider than the width of the strip 1 are disposed in the width direction of the steel sheet so as to face the strip 1 at a position higher than the surface of the plating solution on the side of the exit for the strip 1 to pass through, and a gas is ejected toward the strip 1.

It is preferable that the slit gas nozzles 8 be disposed downstream of the conductor roll 2. Here, it is preferable that the slit gas nozzles 8 be disposed upstream of a strip-passing roll 7 disposed on the side of the exit for the strip 1 to pass through, that is, it is preferable that the slit gas nozzles 8 be disposed between the conductor roll 2 and the strip-passing roll 7 disposed on the side of the exit for the strip 1 to pass through so as to decrease the amount of the plating solution 4 which adheres to the strip-passing roll 7. However, in the case where it is not possible to find a space in which the slit gas nozzles 8 are disposed, the slit gas nozzles may be disposed downstream of the strip-passing roll 7 disposed on the side of the exit for the strip 1 to pass through. In addition, it is preferable that the slit gas nozzles 8 be disposed on the sides of the front and back surfaces of the strip 1. In this case, it is preferable that a distance of 100 mm or more in the longitudinal direction of the strip 1 be created between the slit gas nozzles 8 disposed on the sides of the front and back surfaces of the steel sheet so as to prevent the plating solution from being scattered due to the collision of the gas ejected through the slit gas nozzles 8.

Moreover, in accordance with aspects of the present invention, it is preferable that spray nozzles 9 be disposed between the strip 1 and the slit gas nozzles 8 so as to eject a solution having a pH of 4 to 7 through the spray nozzles 9 toward the strip 1 (a second embodiment).

In accordance with aspects of the present invention, by disposing the spray nozzles 9 between the strip 1 and the slit gas nozzles 8 on the side of the exit for the strip 1 to pass through, and by ejecting the solution having a pH of 4 to 7 through the spray nozzles 9 toward the strip 1, the degree of acidity of the plating solution having strong acidity which remains on the strip 1 is decreased, and the surface to be plated of the strip 1 is kept weakly acidic. With this, it is possible to inhibit a plating film from being dissolved by the plating solution. Moreover, by disposing the slit gas nozzles 8 having the ejection ports having a width wider than the width of the steel sheet downstream of the spray nozzles 9, and by ejecting a gas through the slit gas nozzles 8 toward the strip 1, the thickness of a film formed of a remaining solution which adheres to the surface of the strip 1 after the solution having a pH of 4 to 7 has been ejected (hereinafter, also simply referred to as "remaining solution", which means a mixture of the solution having a pH of 4 to 7 which has been ejected through the spray nozzles 9 and the plating solution whose acidity has been decreased) is homogenized. Since the remaining solution which adheres to the steel sheet is still acidic, the coating film is dissolved in the case where the remaining solution is left as is. Therefore, the gas is ejected through the slit gas nozzles 8 to prevent the amount of the plating film dissolved from varying. As a result, it is possible to homogenize the liquid film formed of the plating solution which remains on the surface of the steel sheet in a zone between the electroplating cells, in which plating is not performed. Therefore, it is possible to homogenize a coating thickness which is finally obtained and to achieve good esthetic surface appearance.

Figure 4:
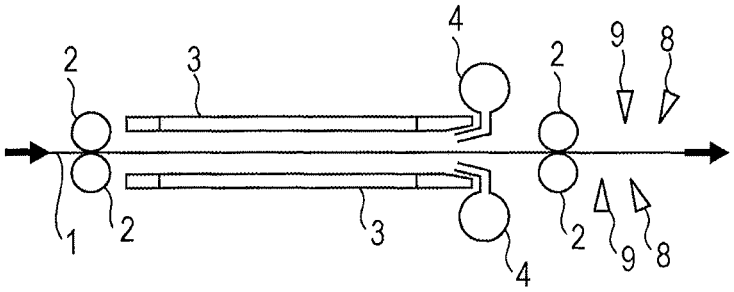
FIG. 4 is a diagram illustrating the structure of an electroplating cell used in a horizontal flow cell method according to a second embodiment of the present invention.

FIG. 4 is a diagram illustrating the structure of an electroplating cell used in a horizontal flow cell method according to the second embodiment of the present invention. Electroplating is performed by making a strip 1 travel in a horizontal direction, by feeding a plating solution 4 into gaps between the strip 1 and anode electrodes 3, and by conducting a current between the surfaces to be plated of the strip 1 being a cathode, and the anode electrodes 3.

On the side of an exit for the strip 1 to pass through, plural spray nozzles 9, through which a solution having a pH of 4 to 7 is ejected toward the strip 1, are disposed in the width direction. Moreover, downstream of the spray nozzles 9, slit gas nozzles 8 having ejection ports having a width wider than the width of the strip 1 are disposed in the width direction of the steel sheet so as to face the strip 1, and gas is ejected toward the strip 1.

It is necessary that the solution to be ejected toward the strip 1 have a function of decreasing the degree of acidity of a remaining plating solution which adheres to the surface of the strip 1 so as to prevent a plating film from being dissolved. Therefore, the pH of the solution which is ejected toward the strip 1 is set to be 4 to 7. In the case where the pH is less than 4, there is only a slight effect of decreasing the degree of acidity of the acidic plating solution. On the other hand, in the case where the pH is more than 7, metallic ions in the plating solution are hydrated and hydroxides are formed on the surface of the strip 1, which results in an increased risk of, for example, pressing flaws occurring.

It is necessary that the amount of the solution to be ejected toward the strip 1 be set so that the pH of the solution which adheres to the strip 1 after the ejection has been performed is more than 1. Although it is preferable that the pH of the solution which adheres to the strip 1 after the ejection has been performed be as high as possible, it is necessary that the pH be lower than that with which metallic ions in the plating solutions are hydrated and hydroxides are formed on the surface of the strip 1. In addition, it is necessary to determine the amount of the solution to be ejected in consideration of the amount of a remaining solution which is decreased by the slit gas nozzles 8 and the scattering state of the remaining solution.

Here, since the amount of the solution having a pH of 4 to 7 which has been ejected and remained on the surface of the strip 1 is small, the influence of such a solution on the chemical composition and pH of a plating solution when the strip 1 is subjected to electroplating in subsequent plating cells on the downstream side among connected plating cells is almost negligible.

Since it is satisfactory that the solution having a pH of 4 to 7 be ejected across the whole width of the strip 1, plural spray nozzles 9 may be disposed in the width direction of the strip 1. In addition, it is preferable that the spray nozzles 9 and the slit gas nozzles 8 be disposed downstream of the conductor rolls 2 disposed on the side of the exit for the strip 1 to pass through so as to prevent the solution having a pH of 4 to 7 from being mixed in the cell. In addition, it is preferable that the spray nozzles 9 be disposed on the sides of the front and back surfaces of the strip 1, and it is preferable that a distance of 100 mm or more in the longitudinal direction of the strip 1 be created between the spray nozzles on one side and those on the other side.

The slit gas nozzles 8 have ejection ports having a width wider than the width of the strip 1, because this is necessary to homogenize the liquid film formed of the remaining solution across the whole width of the strip.

In addition, it is preferable that the slit gas nozzles 8 be disposed on the sides of the front and back surfaces of the strip 1. In the case where the slit gas nozzle 8 disposed on the side of the front surface of the strip 1 and the slit gas nozzle 8 disposed on the side of the back surface of the strip 1 are disposed so as to face each other, a gas collision occurs outside of the strip 1 in the width direction due to the flows of the gas ejected through the slit gas nozzles 8 disposed on both sides, which results in a tendency for the plating solution 4 to be widely scattered. Therefore, in the case where the slit gas nozzles 8 are disposed on the sides of the front and back surfaces of the strip 1, it is preferable that a distance of 100 mm or more in the longitudinal direction of the strip 1 be created between the slit gas nozzle 8 disposed on the side of the front surface of the strip 1 and the slit gas nozzle 8 disposed on the side of the back surface of the strip 1.

Figure 5:
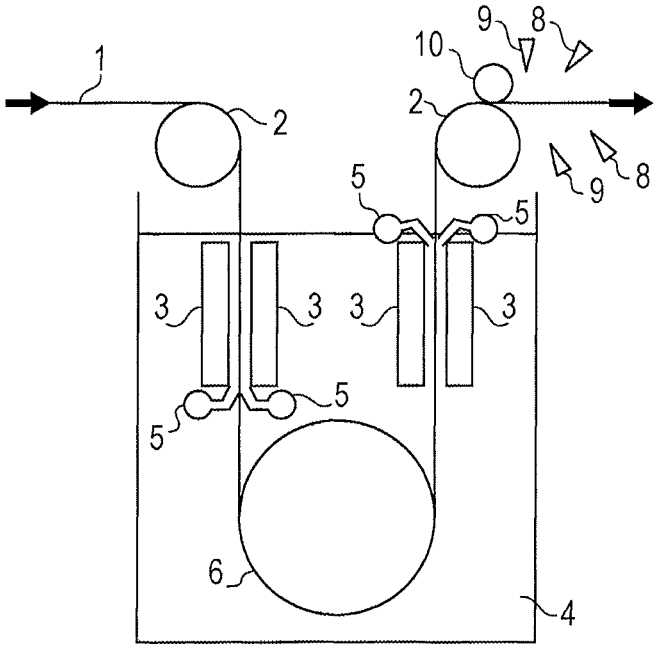
FIG. 5 is a diagram illustrating the structure of an electroplating cell used in a vertical flow cell method according to the second embodiment of the present invention.

FIG. 5 is a diagram illustrating the structure of an electroplating cell used in a vertical flow cell method according to the second embodiment of the present invention. Electroplating is performed by changing the traveling direction of a strip 1 to a downward direction by a conductor roll 2, by feeding a plating solution 4 through flow nozzles 5 into gaps between the strip 1 and anode electrodes 3, and by conducting a current between the surfaces to be plated of the strip 1 being a cathode, and the anode electrodes 3.

On the side of an exit for the strip 1 to pass through, spray nozzles 9 are disposed in the width direction of the steel sheet, and a solution having a pH of 4 to 7 is ejected through the spray nozzles 9 toward the strip 1. Moreover, downstream of the spray nozzles 9, slit gas nozzles 8 having ejection ports having a width wider than the width of the steel sheet are disposed in the width direction so as to face the strip 1, and gas is ejected toward the strip 1. By using the spray nozzles 9, the degree of acidity of the plating solution having strong acidity which remains on the strip 1 is decreased, the surface to be plated of the strip 1 is kept weakly acidic, and the dissolution of a plating film by the plating solution 4 is inhibited. Moreover, by ejecting a gas through the slit gas nozzles 8 toward the strip 1, the thickness of a film formed of a remaining solution which adheres to the surface of the strip 1 is homogenized. As a result, it is possible to homogenize the liquid film formed of the plating solution which remains on the surface of the steel sheet in a zone between the electroplating cells, in which plating is not performed. Therefore, it is possible to homogenize a coating thickness which is finally obtained and to achieve good esthetic surface appearance.

Since it is satisfactory that the solution having a pH of 4 to 7 be ejected to the whole width of the strip 1, plural spray nozzles 9 may be disposed in the width direction of the strip 1. In addition, it is preferable that the spray nozzles 9 and the slit gas nozzles 8 be disposed downstream of the conductor roll 2 disposed on the side of the exit for the strip 1 to pass through to prevent the solution having a pH of 4 to 7 from being mixed in the cell. In addition, it is preferable that the spray nozzles 9 be disposed on the sides of the front and back surfaces of the strip 1, and it is preferable that a distance of 100 mm or more in the longitudinal direction of the strip 1 be created between the spray nozzles on one side and those on the other side.

Here, as in the case of the horizontal flow cell method described above, the pH of the solution to be ejected toward the strip 1 is set to be 4 to 7, and the amount of the solution to be ejected is set so that the pH of the solution which adheres to the strip 1 after the ejection has been performed is more than 1.

In addition, before (upstream of) the spray nozzles 9 disposed on the side of the front surface of the strip 1 (the upper surface of the strip 1 when the steel sheet is made to horizontally travel) on the side of exit for the strip 1 to pass through, an additional roll 10 may be disposed to prevent the solution having a pH of 4 to 7 from being mixed in the cell.

In addition, it is preferable that the slit gas nozzles 8 be disposed on the sides of the front and back surfaces of the strip 1. It is preferable that a distance of 100 mm or more in the longitudinal direction of the strip 1 be created between the slit gas nozzles 8 disposed on the sides of the front and back surfaces of the steel sheet so as to prevent the plating solution from being scattered due to the collision of the gas ejected through the slit gas nozzles 8.

Figure 6:
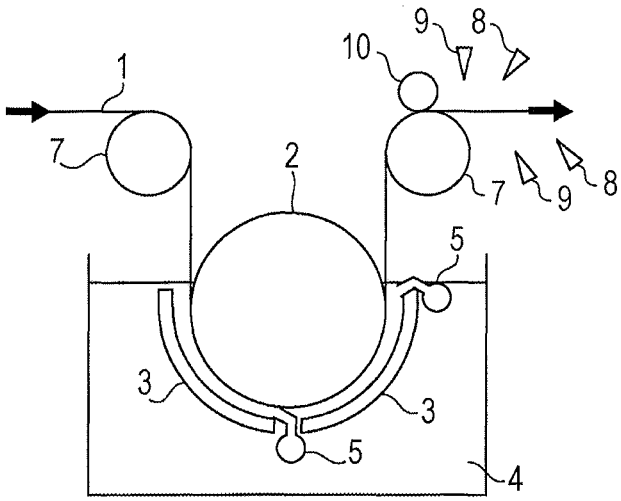
FIG. 6 is a diagram illustrating the structure of an electroplating cell used in a radial cell method according to the second embodiment of the present invention.
Figure 7:
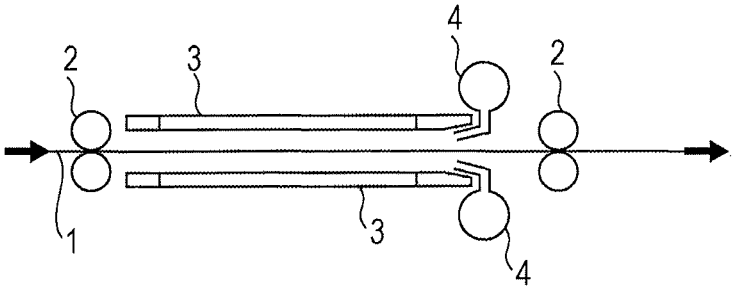
FIG. 7 is a diagram illustrating the structure of an electroplating cell used in a horizontal flow cell method of the related art.
Figure 8:
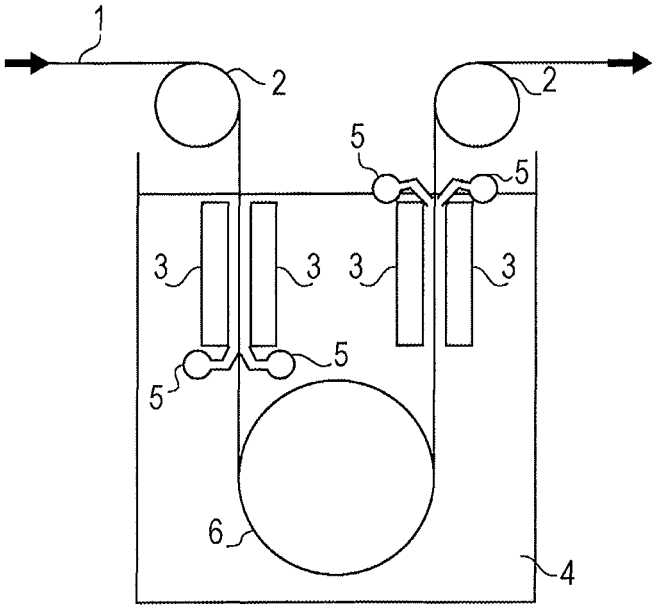
FIG. 8 is a diagram illustrating the structure of an electroplating cell used in a vertical flow cell method of the related art.
Figure 9:
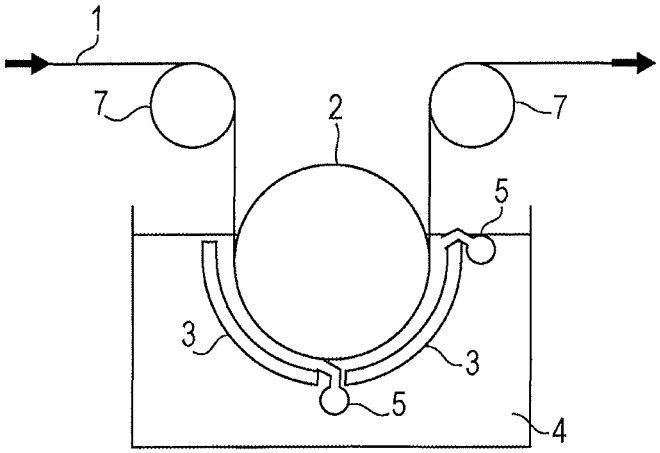
FIG. 9 is a diagram illustrating the structure of an electroplating cell used in a radial cell method of the related art.

FIG. 6 is a diagram illustrating the structure of an electroplating cell used in a radial cell method according to the second embodiment of the present invention. Electroplating is performed by making a strip 1 travel with the strip being wound around a conductor roll 2, by feeding a plating solution 4 through flow nozzles 5 into gaps between the strip 1 and anode electrodes 3, and by conducting a current between the surface to be plated of the strip 1 being a cathode, and the anode electrodes 3.

On the side of an exit for the strip 1 to pass through, spray nozzles 9 are disposed in the width direction of the steel sheet, and a solution having a pH of 4 to 7 is ejected through the spray nozzles 9 toward the strip 1. Moreover, downstream of the spray nozzles 9, slit gas nozzles 8 having ejection ports having a width wider than the width of the steel sheet are disposed in the width direction so as to face the strip 1, and gas is ejected toward the strip 1. By using the spray nozzles 9, the degree of acidity of the plating solution having strong acidity which remains on the strip 1 is decreased, the surface to be plated of the strip 1 is kept weakly acidic, and the dissolution of a plating film by the plating solution 4 is inhibited. Moreover, by ejecting a gas through the slit gas nozzles 8 toward the strip 1, the thickness of a film formed of a remaining solution which adheres to the surface of the strip 1 is homogenized. As a result, it is possible to homogenize the liquid film formed of the plating solution which remains on the surface of the steel sheet in a zone between the electroplating cells, in which plating is not performed. Therefore, it is possible to homogenize a coating thickness which is finally obtained and to achieve good esthetic surface appearance.

Since it is satisfactory that the solution having a pH of 4 to 7 be ejected to the whole width of the strip 1, plural spray nozzles 9 may be disposed in the width direction of the strip 1. In addition, it is preferable that the spray nozzles 9 and the slit gas nozzles 8 be disposed downstream of the strip passing roll 7 disposed on the side of the exit for the strip 1 to pass through so as to prevent the solution having a pH of 4 to 7 from being mixed in the cell. In addition, it is preferable that the spray nozzles 9 be disposed on the sides of the front and back surfaces of the strip 1, and it is preferable that a distance of 100 mm or more in the longitudinal direction of the strip 1 be created between the spray nozzles on one side and those on the other side.

Here, as in the case of the horizontal flow cell method described above, the pH of the solution to be ejected toward the strip 1 is set to be 4 to 7, and the amount of the solution to be ejected is set so that the pH of the solution which adheres to the strip 1 after the ejection has been performed is more than 1.

In addition, before (upstream of) the spray nozzles 9 disposed on the side of the front surface of the strip 1 (the upper surface of the strip 1 when the steel sheet is made horizontally travel) on the side of exit for the strip 1 to pass through, an additional roll 10 may be disposed to prevent the solution having a pH of 4 to 7 from being mixed in the cell.

In addition, it is preferable that the slit gas nozzles 8 be disposed on the sides of the front and back surfaces of the strip 1. It is preferable that a distance of 100 mm or more in the longitudinal direction of the strip 1 be created between the slit gas nozzles 8 disposed on the sides of the front and back surfaces of the steel sheet so as to prevent the plating solution from being scattered due to the collision of the gas ejected through the slit gas nozzles 8.

Here, it is preferable that the kind of the solution having a pH of 4 to 7 be determined in accordance with the kind of the plating solution 4. For example, in the case of a sulfuric acid-based plating solution, sulfuric acid having a pH of 4 to 7 may be used.

As the gas to be ejected through the slit gas nozzle 8, air can preferably be used from the viewpoint of cost and environment conservation. An inert gas such as nitrogen gas may be used.

It is preferable that the nozzle gap (nozzle slit gap) of the slit gas nozzle 8 be 0.3 mm to 2.0 mm. In the case where the nozzle gap is less than 0.3 mm, it is not possible to sufficiently realize the effect of decreasing the amount of a plating solution, and nozzle clogging due to a scattered plating solution tends to occur. In addition, in the case where the nozzle gap is more than 2.0 mm, since excessive amount of gas is ejected, a plating solution tends to be scattered, which results in a deterioration, rather than an improvement, in surface appearance. In addition, it is more preferable that the nozzle gap be 0.3 mm to 1.5 mm.

In accordance with aspects of the present invention, it is preferable that a distance between the nozzle tips of the slit gas nozzles 8 and the strip 1 be 5 mm to 100 mm. In the case where the distance is less than 5 mm, the slit gas nozzles 8 may come into contact with the strip 1. In addition, in the case where the distance between the nozzle tips of the slit gas nozzles 8 and the strip 1 is more than 100 mm, it is not possible to sufficiently realize the effect of decreasing the amount of the plating solution. In addition, it is more preferable that the lower limit of the distance between the slit gas nozzles 8 and the strip 1 be 5 mm or more and that the upper limit of the distance be 50 mm or less.

It is preferable that an ejection pressure of the slit gas nozzle 8 be 1 kPa to 10 kPa. In the case where the pressure is lower than 1 kPa, it is not possible to sufficiently realize the effect of decreasing the amount of the plating solution. In addition, in the case where the pressure is higher than 10 kPa, a plating solution tends to be scattered, which results in a deterioration, rather than an improvement, in surface appearance. It is more preferable that the ejection pressure of the slit gas nozzle 8 be changed in accordance with a line speed (increased with an increase in the speed).

Aspects of the present invention are effective for improving plating homogeneity and a variation in surface appearance even in the case of an ordinary plating solution (having a pH of 1.5 to 2.0). However, in the case where the pH of the plating solution when electroplating is performed is controlled to be −0.5 to 1.0 to increase current density, the effect according to aspects of the present invention becomes more marked.

In accordance with aspects of the present invention, it is preferable that current density at the time of a current being conducted when electroplating is performed be 150 A/dm$^2$ to 1200 A/dm$^2$. In the case where the current density is less than 150 A/dm$^2$, since it is not possible to sufficiently increase the strip-passing speed, there is a tendency for surface appearance and a variation in coating weight to deteriorate due to an increase in the time for which the strip 1 passes a zone between plating cells, in which plating is not performed. On the other hand, in the case where the current density is more than 1200 A/dm$^2$, since there is a variation in crystal orientation in a coating film, "plating burning", in which a coated surface is blackened, occurs.

Here, in the case of a flow cell method, since a current is conducted in the longitudinal direction inside a steel sheet (from the anode electrodes to the conductor rolls), it is possible to increase the current density up to 400 A/dm$^2$ from the viewpoint of the limitation on heat generation in the steel sheet. In addition, in the case of a radial cell method, since a current is conducted in the thickness direction inside a steel sheet, there is almost no increase in the temperature of the steel sheet, which makes it possible to increase the current density up to 1200 A/dm$^2$.

Example 1

Hereafter, the example of the present invention will be described. The technical scope of the present invention is not limited to the examples below.

In the examples of the present invention, electroplating was performed to manufacture electroplated steel sheets by using electroplating cells having the structures illustrated in FIGS. 1 through 3. As a strip 1, a cold-rolled steel strip having a thickness of 0.5 mm and a width of 1000 mm was made to travel at a line speed of 1.83 m/s to 5.0 m/s. An anode electrode 3, which was made of titanium, had a conductor surface coated with an iridium oxide film and a width covering almost the whole width of the strip 1. Various plating solutions 4 having various values for pH, a zinc sulfate concentration of 400 g/L, and a temperature kept at 60° C. were used. The lower limit of a coating weight per side was set to be 20 g/m$^2$. A coating thickness was determined on three longitudinal lines respectively passing through three points arrayed in the width direction with determination being performed at 10 points arrayed on each of the lines to calculate the average value of the 30 points and a variation in coating weight (g/m$^2$) (the difference between the maximum and minimum values). A case where a variation in coating weight was within 2.0 g/m$^2$ was judged as a case of a homogeneous coating thickness.

Surface appearance was evaluated by using an L-value which was determined at the same positions as those where the coating weight was determined by using a colorimeter. Evaluation was conducted on a 5-point scale, where a case of high degree of whiteness with a small variation was judged as 5 (good) and a case of low degree of whiteness with a large variation was judged as 1 (poor). A case judged as 4 or better was judged as satisfactory.

The plating conditions and the results are given in Table 1.

TABLE 1

| | Plating Condition | | | | | | | | |
|---|---|---|---|---|---|---|---|---|---|
| | | Strip | | | | Slit Gas Nozzle | | | |
| No. | Type of Cell | Number of Cells | Traveling Speed (m/s) | pH of Plating Solution | Current Density (A/dm$^2$) | Location | Gap (mm) | Distance (mm) | Ejection Pressure (kPa) |
| 1 | Horizontal Flow Cell | 7 | 2.07 | 1.5 | 80 | | Non-use | | |
| 2 | Horizontal Flow Cell | 5 | 5.00 | 0.2 | 270 | | Non-use | | |
| 3 | Vertical Flow Cell | 7 | 2.07 | 1.5 | 80 | | Non-use | | |
| 4 | Vertical Flow Cell | 5 | 5.00 | 0.2 | 270 | | Non-use | | |
| 5 | Radial Cell | 8 | 2.25 | 1.5 | 135 | | Non-use | | |
| 6 | Radial Cell | 4 | 5.00 | 0.2 | 680 | | Non-use | | |
| 7 | Radial Cell | 2 | 5.00 | 0.0 | 1200 | | Non-use | | |
| 8 | Horizontal Flow Cell | 7 | 2.07 | 1.5 | 80 | Front | 0.4 | 10 | 1.0 |
| 9 | Horizontal Flow Cell | 5 | 5.00 | 0.2 | 270 | Front | 0.4 | 110 | 12.0 |
| 10 | Horizontal Flow Cell | 5 | 5.00 | 0.2 | 270 | Front and Back | 0.4 | 10 | 3.0 |
| 11 | Horizontal Flow Cell | 5 | 5.00 | 0.2 | 270 | Front and Back | 2.5 | 10 | 3.0 |
| 12 | Vertical Flow Cell | 7 | 2.07 | 1.5 | 80 | Front and Back | 1.0 | 15 | 2.0 |
| 13 | Vertical Flow Cell | 5 | 5.00 | 0.2 | 270 | Front and Back | 1.0 | 15 | 4.0 |
| 14 | Vertical Flow Cell | 5 | 5.00 | −0.3 | 270 | Front and Back | 1.0 | 15 | 4.0 |
| 15 | Radial Cell | 8 | 5.00 | 1.5 | 150 | Front and Back | 1.5 | 30 | 5.0 |
| 16 | Radial Cell | 4 | 5.00 | 0.2 | 680 | Front and Back | 1.5 | 120 | 15.0 |
| 17 | Radial Cell | 4 | 5.00 | 0.2 | 680 | Front and Back | 2.5 | 30 | 5.0 |
| 18 | Radial Cell | 4 | 5.00 | 0.2 | 680 | Front and Back | 1.5 | 90 | 9.0 |
| 19 | Radial Cell | 4 | 5.00 | 0.2 | 680 | Front and Back | 1.5 | 30 | 5.0 |
| 20 | Radial Cell | 2 | 5.00 | 0.0 | 1200 | Front and Back | 1.5 | 30 | 3.0 |
| 21 | Radial Cell | 2 | 5.00 | −0.5 | 1200 | Front and Back | 1.5 | 30 | 3.0 |

| | Evaluation after Plating | | | |
|---|---|---|---|---|
| No. | Average Coating Weight (g/m$^2$) | Variation in Coating Weight (g/m$^2$) | Variation in Surface Appearance | Note |
| 1 | 20.5 | 2.3 | 4 | Comparative Example |
| 2 | 20.2 | 5.2 | 1 | Comparative Example |
| 3 | 20.8 | 2.5 | 3 | Comparative Example |
| 4 | 20.5 | 4.8 | 1 | Comparative Example |
| 5 | 21.0 | 3.5 | 3 | Comparative Example |
| 6 | 19.1 | 6.2 | 1 | Comparative Example |
| 7 | 18.2 | 7.4 | 1 | Comparative Example |
| 8 | 21.6 | 1.3 | 4 | Example |
| 9 | 21.5 | 1.6 | 4 | Example |
| 10 | 21.7 | 0.5 | 5 | Example |
| 11 | 20.6 | 1.7 | 4 | Example |
| 12 | 21.3 | 1.3 | 4 | Example |
| 13 | 21.5 | 0.4 | 5 | Example |
| 14 | 21.3 | 0.5 | 5 | Example |
| 15 | 22.3 | 1.1 | 4 | Example |
| 16 | 21.2 | 1.2 | 4 | Example |
| 17 | 21.4 | 1.6 | 4 | Example |
| 18 | 21.7 | 0.4 | 5 | Example |
| 19 | 21.8 | 0.4 | 5 | Example |
| 20 | 21.3 | 0.4 | 5 | Example |
| 21 | 21.2 | 0.5 | 5 | Example |

From the results given in Table 1, it is clarified that, in the case where electroplating was performed by using the electroplating cells according to aspects of the present invention, the electroplated steel sheets had a homogeneous coating thickness and good esthetic surface appearance.

Example 2

In the examples of the present invention, electroplating was performed to manufacture electroplated steel sheets by using electroplating cells having the structures illustrated in FIGS. 4 through 6. As a strip 1, a cold-rolled steel strip having a thickness of 0.5 mm and a width of 1000 mm was made to travel at a line speed of 2.07 m/s to 5.0 m/s. An anode electrode 3, which was made of titanium, had a conductor surface coated with an iridium oxide film and a width almost covering the whole width of the strip 1. Various plating solutions 4 having various values for pH, a zinc sulfate concentration of 400 g/L, and a temperature kept at 60° C. were used. The lower limit of a coating weight per side was set to be 20 g/m$^2$. As a solution to be ejected through the spray nozzles 9, sulfuric acid was used with pH being appropriately controlled.

A coating thickness was determined on three longitudinal lines respectively passing through three points arrayed in the width direction with determination being performed at 10 points arrayed on each of the lines to calculate the average value of the 30 points and a variation in coating weight ($g/m^2$) (the difference between the maximum and the minimum). A case where a variation in coating weight was within 2.0 $g/m^2$ was judged as a case of a homogeneous coating thickness.

Surface appearance was evaluated by using an L-value which was determined at the same positions as those where the coating weight was determined by using a colorimeter. Evaluation was conducted on a 5-point scale, where a case of high degree of whiteness with a small variation was judged as 5 (good) and a case of low degree of whiteness with a large variation was judged as 1 (poor). A case judged as 4 or better was judged as satisfactory.

The plating conditions and the results are given in Table 1.

TABLE 2

| | Plating Condition | | | | | | | | |
|---|---|---|---|---|---|---|---|---|---|
| | | Strip | | | | Spray Nozzle | | | |
| No. | Type of Cell | Number of Cells | Traveling Speed (m/s) | pH of Plating Solution | Current Density ($A/dm^2$) | Location | Flow Density ($L/min \cdot m^2$) | pH of Solution | Slit Gas Nozzle Location |
| 1 | Horizontal Flow Cell | 7 | 2.07 | 1.5 | 80 | | Non-use | | Non-use |
| 2 | Horizontal Flow Cell | 5 | 5.00 | 0.2 | 270 | | Non-use | | Non-use |
| 3 | Vertical Flow Cell | 7 | 2.07 | 1.5 | 80 | | Non-use | | Non-use |
| 4 | Vertical Flow Cell | 5 | 5.00 | 0.2 | 270 | | Non-use | | Non-use |
| 5 | Radial Cell | 8 | 2.25 | 1.5 | 135 | | Non-use | | Non-use |
| 6 | Radial Cell | 4 | 5.00 | 0.2 | 680 | | Non-use | | Non-use |
| 7 | Radial Cell | 2 | 5.00 | 0.0 | 1200 | | Non-use | | Non-use |
| 8 | Horizontal Flow Cell | 7 | 2.07 | 1.5 | 80 | Front | 20 | 4.5 | Front |
| 9 | Horizontal Flow Cell | 5 | 5.00 | 0.2 | 270 | Front | 20 | 4.5 | Front |
| 10 | Horizontal Flow Cell | 5 | 5.00 | 0.2 | 270 | Front and Back | 20 | 4.5 | Non-use |
| 11 | Horizontal Flow Cell | 5 | 5.00 | 0.2 | 270 | Front and Back | 20 | 4.5 | Front and Back |
| 12 | Horizontal Flow Cell | 5 | 5.00 | 0.2 | 270 | Front and Back | 20 | 4.5 | Front and Back |
| 13 | Vertical Flow Cell | 7 | 2.07 | 1.5 | 80 | Front and Back | 20 | 5.5 | Front and Back |
| 14 | Vertical Flow Cell | 5 | 5.00 | 0.2 | 270 | Front and Back | 20 | 5.5 | Non-use |
| 15 | Vertical Flow Cell | 5 | 5.00 | 0.2 | 270 | Front and Back | 20 | 3.5 | Front and Back |
| 16 | Vertical Flow Cell | 5 | 5.00 | 0.2 | 270 | Front and Back | 20 | 5.5 | Front and Back |
| 17 | Vertical Flow Cell | 5 | 5.00 | 0.2 | 270 | Front and Back | 20 | 7.5 | Front and Back |
| 18 | Vertical Flow Cell | 5 | 5.00 | −0.5 | 270 | Front and Back | 20 | 5.5 | Front and Back |
| 19 | Radial Cell | 8 | 1.83 | 1.5 | 135 | Front and Back | 20 | 4.5 | Front and Back |
| 20 | Radial Cell | 4 | 5.00 | 0.2 | 680 | Front and Back | 20 | 6.5 | Front and Back |
| 21 | Radial Cell | 4 | 5.00 | 0.2 | 680 | Front and Back | 20 | 6.5 | Front and Back |
| 22 | Radial Cell | 4 | 5.00 | 0.2 | 680 | Front and Back | 20 | 3.5 | Front and Back |
| 23 | Radial Cell | 4 | 5.00 | 0.2 | 680 | Front and Back | 20 | 4.5 | Front and Back |
| 24 | Radial Cell | 4 | 5.00 | 0.2 | 680 | Front and Back | 20 | 7.5 | Front and Back |
| 25 | Radial Cell | 2 | 5.00 | 0.0 | 1200 | Front and Back | 20 | 4.5 | Front and Back |
| 26 | Radial Cell | 2 | 5.00 | −0.3 | 1200 | Front and Back | 20 | 4.5 | Front and Back |

| | Slit Gas Nozzle | | | Evaluation after Plating | | | |
|---|---|---|---|---|---|---|---|
| No. | Gap (mm) | Distance (mm) | Ejection Pressure (kPa) | Average Coating Weight ($g/m^2$) | Variation in Coating Weight ($g/m^2$) | Variation in Surface Appearance | Note |
| 1 | | Non-use | | 20.5 | 2.3 | 4 | Comparative Example |
| 2 | | Non-use | | 20.2 | 5.2 | 1 | Comparative Example |
| 3 | | Non-use | | 20.8 | 2.5 | 3 | Comparative Example |
| 4 | | Non-use | | 20.5 | 4.8 | 1 | Comparative Example |
| 5 | | Non-use | | 21.0 | 3.5 | 3 | Comparative Example |
| 6 | | Non-use | | 19.1 | 6.2 | 1 | Comparative Example |
| 7 | | Non-use | | 18.2 | 7.4 | 1 | Comparative Example |
| 8 | 0.4 | 10 | 1.0 | 21.7 | 1.1 | 4 | Example |
| 9 | 0.4 | 110 | 12.0 | 21.6 | 1.4 | 4 | Example |
| 10 | | Non-use | | 21.0 | 2.0 | 3 | Comparative Example |
| 11 | 0.4 | 10 | 3.0 | 21.8 | 0.7 | 5 | Example |
| 12 | 2.2 | 10 | 3.0 | 20.9 | 1.5 | 4 | Example |
| 13 | 1.0 | 15 | 2.0 | 21.5 | 0.9 | 4 | Example |
| 14 | | Non-use | | 21.3 | 2.1 | 3 | Comparative Example |
| 15 | 1.0 | 15 | 4.0 | 20.9 | 1.2 | 3 | Comparative Example |
| 16 | 1.0 | 15 | 4.0 | 21.7 | 0.3 | 5 | Example |
| 17 | 1.0 | 15 | 4.0 | 21.7 | 1.2 | 2 | Comparative Example |
| 18 | 1.0 | 15 | 4.0 | 20.9 | 0.3 | 5 | Example |
| 19 | 1.5 | 30 | 5.0 | 21.7 | 0.3 | 4 | Example |
| 20 | 1.5 | 120 | 15.0 | 21.3 | 1.0 | 4 | Example |
| 21 | 1.5 | 90 | 9.0 | 21.5 | 0.5 | 5 | Example |
| 22 | 1.5 | 30 | 5.0 | 21.0 | 2.3 | 3 | Comparative Example |
| 23 | 1.5 | 30 | 5.0 | 21.4 | 0.3 | 5 | Example |
| 24 | 1.5 | 30 | 5.0 | 21.4 | 1.2 | 2 | Comparative Example |
| 25 | 1.5 | 30 | 3.0 | 21.2 | 0.3 | 5 | Example |
| 26 | 1.5 | 30 | 3.0 | 20.8 | 0.3 | 5 | Example |

From the results given in Table 2, it is clarified that, in the case where electroplating was performed by using the cells according to aspects of the present invention, the electroplated steel sheets had a homogeneous coating thickness and good esthetic surface appearance.

REFERENCE SIGNS LIST

1 strip (steel sheet)
2 conductor roll
3 anode electrode
4 plating solution
5 flow nozzle
6 sink roll
7 strip-passing roll
8 slit gas nozzle
9 spray nozzle
10 roll

The invention claimed is:

1. A method for manufacturing an electroplated steel sheet, the method comprising:

continuously performing electroplating on a steel sheet; and, during the performing, disposing slit gas nozzles having an ejection port having a width wider than a width of the steel sheet in a width direction of the steel sheet on a side of an exit of an electroplating cell for the steel sheet to pass through, and ejecting a gas through the slit gas nozzles toward the steel sheet, wherein the slit gas nozzles are disposed on sides of front and back surfaces of the steel sheet, and there is a first offset of 100 mm or more in a longitudinal direction of the steel sheet between a first slit gas nozzle and a second slit gas nozzle, the first slit gas nozzle being one of the slit gas nozzles disposed on the side of the front surface of the steel sheet and the second slit gas nozzle being one of the slit gas nozzles disposed on the side of the back surface of the steel sheet.

2. The method for manufacturing an electroplated steel sheet according to claim 1, wherein the electroplating cell is a horizontal flow cell, and wherein the slit gas nozzles are disposed on each side of front and back surfaces of the steel sheet downstream of conductor rolls disposed on the side of the exit for the steel sheet to pass through.

3. The method for manufacturing an electroplated steel sheet according to claim 1, wherein the electroplating cell is a vertical flow cell, and wherein the slit gas nozzles are disposed on each side of front and back surfaces of the steel sheet upstream of conductor rolls disposed on the side of the exit for the steel sheet to pass through.

4. The method for manufacturing an electroplated steel sheet according to claim 1, wherein the electroplating cell is a radial cell, and wherein the slit gas nozzles are disposed on each side of front and back surfaces of the steel sheet downstream of a conductor roll.

5. The method for manufacturing an electroplated steel sheet according to claim 1, wherein the slit gas nozzles have a nozzle slit gap of 0.3 mm to 2.0 mm, wherein the slit gas nozzles are disposed so that a second offset between a nozzle tip and the steel sheet is 5 mm to 100 mm, and wherein an ejection pressure of the slit gas nozzles is 1 kPa to 10 kPa.

6. The method for manufacturing an electroplated steel sheet according to claim 1, wherein a solution for electroplating the steel sheet has a pH of −0.5 to 1.0.

7. The method for manufacturing an electroplated steel sheet according to claim 1, wherein a current density for electroplating the steel sheet is 150 A/dm$^2$ to 1200 A/dm$^2$.

8. The method for manufacturing an electroplated steel sheet according to claim 1, wherein there is the first offset of 100 mm or more in the longitudinal direction of the steel sheet between all of the slit gas nozzles disposed on the side of the front surface of the steel sheet and all of the slit gas nozzles disposed on the side of the back surface of the steel sheet.

9. A method for manufacturing an electroplated steel sheet by continuously performing electroplating on a steel sheet, the method comprising:

continuously performing electroplating on a steel sheet in an electroplating cell; and disposing a spray nozzle in a width direction of the steel sheet on a side of an exit of an electroplating cell for the steel sheet to pass through, ejecting a solution having a pH of 4 to 7 through the spray nozzle toward the steel sheet, further disposing slit gas nozzles having an ejection port having a width wider than a width of the steel sheet in the width direction of the steel sheet downstream of the spray nozzle, and ejecting a gas through the slit gas nozzles toward the steel sheet, wherein the slit gas nozzles are disposed on sides of front and back surfaces of the steel sheet, and there is a first offset of 100 mm or more in a longitudinal direction of the steel sheet between a first slit gas nozzle and a second slit gas nozzle, the first slit gas nozzle being one of the slit gas nozzles disposed on the side of the front surface of the steel sheet and the second slit gas nozzle being one of the slit gas nozzles disposed on the side of the back surface of the steel sheet.

10. The method for manufacturing an electroplated steel sheet according to claim 9, wherein the electroplating cell is a horizontal flow cell or a vertical flow cell, and wherein the spray nozzle and the slit gas nozzles are disposed on each side of front and back surfaces of the steel sheet downstream of conductor rolls disposed on the side of the exit for the steel sheet to pass through.

11. The method for manufacturing an electroplated steel sheet according to claim 9, wherein the electroplating cell is a radial cell, and wherein the spray nozzle and the slit gas nozzles are disposed on each side of front and back surfaces of the steel sheet downstream of a conductor roll.

12. The method for manufacturing an electroplated steel sheet according to claim 9, wherein the slit gas nozzles have a nozzle slit gap of 0.3 mm to 2.0 mm, wherein the slit gas nozzles are disposed so that a second offset between a nozzle tip and the steel sheet is 5 mm to 100 mm, and wherein an ejection pressure of the slit gas nozzles is 1 kPa to 10 kPa.

13. The method for manufacturing an electroplated steel sheet according to claim 9, wherein a plating solution in the electroplating cell has a pH of −0.5 to 1.0.

14. The method for manufacturing an electroplated steel sheet according to claim 9, wherein current density during the performing of the electroplating is 150 A/dm$^2$ to 1200 A/dm$^2$.

* * * * *